US010078279B2

(12) United States Patent
Nakagawa et al.

(10) Patent No.: US 10,078,279 B2
(45) Date of Patent: Sep. 18, 2018

(54) TONER AND METHOD OF PRODUCING TONER

(71) Applicant: CANON KABUSHIKI KAISHA, Tokyo (JP)

(72) Inventors: Yoshihiro Nakagawa, Numazu (JP); Naoya Isono, Suntou-gun (JP); Harumi Takada, Susono (JP); Reo Tagawa, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/366,123

(22) Filed: Dec. 1, 2016

(65) Prior Publication Data

US 2017/0160658 A1 Jun. 8, 2017

(30) Foreign Application Priority Data

Dec. 4, 2015 (JP) ..... 2015-237729

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0812* (2013.01); *G03G 9/0806* (2013.01); *G03G 9/0819* (2013.01); *G03G 9/0825* (2013.01); *G03G 9/08711* (2013.01); *G03G 9/0918* (2013.01)

(58) Field of Classification Search

CPC ..... G03G 9/08782; G03G 9/08711

See application file for complete search history.

(56) References Cited

U.S. PATENT DOCUMENTS 4,960,669 A 10/1990 Mori et al.
6,432,590 B1 * 8/2002 Ueda ..... G03G 9/0825 430/110.3
6,569,589 B2 5/2003 Inaba et al.

(Continued)

FOREIGN PATENT DOCUMENTS

JP 2008-276269 11/2008
JP 2011-043696 3/2011

(Continued)

OTHER PUBLICATIONS

Harazaki, Table 3-9 of Kotingu no Kiso Kagaku (Basic Coating Science) (1986) 54-57.

(Continued)

*Primary Examiner* — Peter L Vajda

(74) *Attorney, Agent, or Firm* — Fitzpatrick Cella Harper and Scinto

(57) ABSTRACT

A toner comprising a toner particle that contains a binder resin and a wax, wherein in a cross sectional image of the toner observed with a transmission electron microscope, the toner satisfies the following formulas (1) and (2)

$$18.0\% \geq As \geq 1.5\% \quad (1)$$

$$10.0 \geq Ac/As \geq 2.0 \quad (2)$$

where As represents the proportion for the area taken up by the wax present in the surface layer region having distance 1.0 μm in a radial direction inward from the surface of the toner, and Ac represents the proportion for the area taken up by the wax present in the inner region positioned further inside than the surface layer region.

18 Claims, 1 Drawing Sheet

(56) References Cited

U.S. PATENT DOCUMENTS

| | | | | |
|---|---|---|---|---|
| 7,169,525 | B2 | 1/2007 | Sugiura et al. | |
| 8,367,289 | B2 | 2/2013 | Isono et al. | |
| 8,440,382 | B2 | 5/2013 | Isono et al. | |
| 8,497,054 | B2 | 7/2013 | Sugiyama et al. | |
| 8,568,948 | B2 | 10/2013 | Fujiwara et al. | |
| 8,603,712 | B2 | 12/2013 | Aoki et al. | |
| 8,652,737 | B2 | 2/2014 | Handa et al. | |
| 8,741,519 | B2 | 6/2014 | Watanabe et al. | |
| 8,778,581 | B2 | 7/2014 | Nonaka et al. | |
| 8,828,633 | B2 | 9/2014 | Itabashi et al. | |
| 8,846,284 | B2 | 9/2014 | Kinumatsu et al. | |
| 9,158,216 | B2 | 10/2015 | Shimano et al. | |
| 9,377,705 | B2 | 6/2016 | Shimano et al. | |
| 9,383,668 | B2 | 7/2016 | Noji et al. | |
| 9,429,860 | B2 | 8/2016 | Kinumatsu et al. | |
| 9,500,972 | B2 | 11/2016 | Tanaka et al. | |
| 9,551,947 | B2 | 1/2017 | Hiroko et al. | |
| 2013/0224642 | A1* | 8/2013 | Pang | G03G 9/087 430/108.4 |
| 2015/0099222 | A1 | 4/2015 | Terui et al. | |
| 2015/0153666 | A1 | 6/2015 | Isono et al. | |
| 2015/0153669 | A1 | 6/2015 | Yoshida et al. | |
| 2015/0234303 | A1* | 8/2015 | Moriya | G03G 9/0819 430/108.2 |
| 2015/0261110 | A1 | 9/2015 | Nakagawa et al. | |
| 2015/0331344 | A1 | 11/2015 | Tominaga et al. | |
| 2015/0370189 | A1 | 12/2015 | Tanaka et al. | |
| 2016/0334727 | A1 | 11/2016 | Tanaka et al. | |
| 2016/0349640 | A1 | 12/2016 | Tanaka et al. | |

FOREIGN PATENT DOCUMENTS

| | | |
|---|---|---|
| JP | 2013-228707 | 11/2013 |
| JP | 2015-004972 | 1/2015 |

OTHER PUBLICATIONS

U.S. Appl. No. 15/198,858, filed Jun. 30, 2016, Yoshihiro Nakagawa.
U.S. Appl. No. 15/234,497, filed Aug. 11, 2016, Tsutomu Shimano.

* cited by examiner

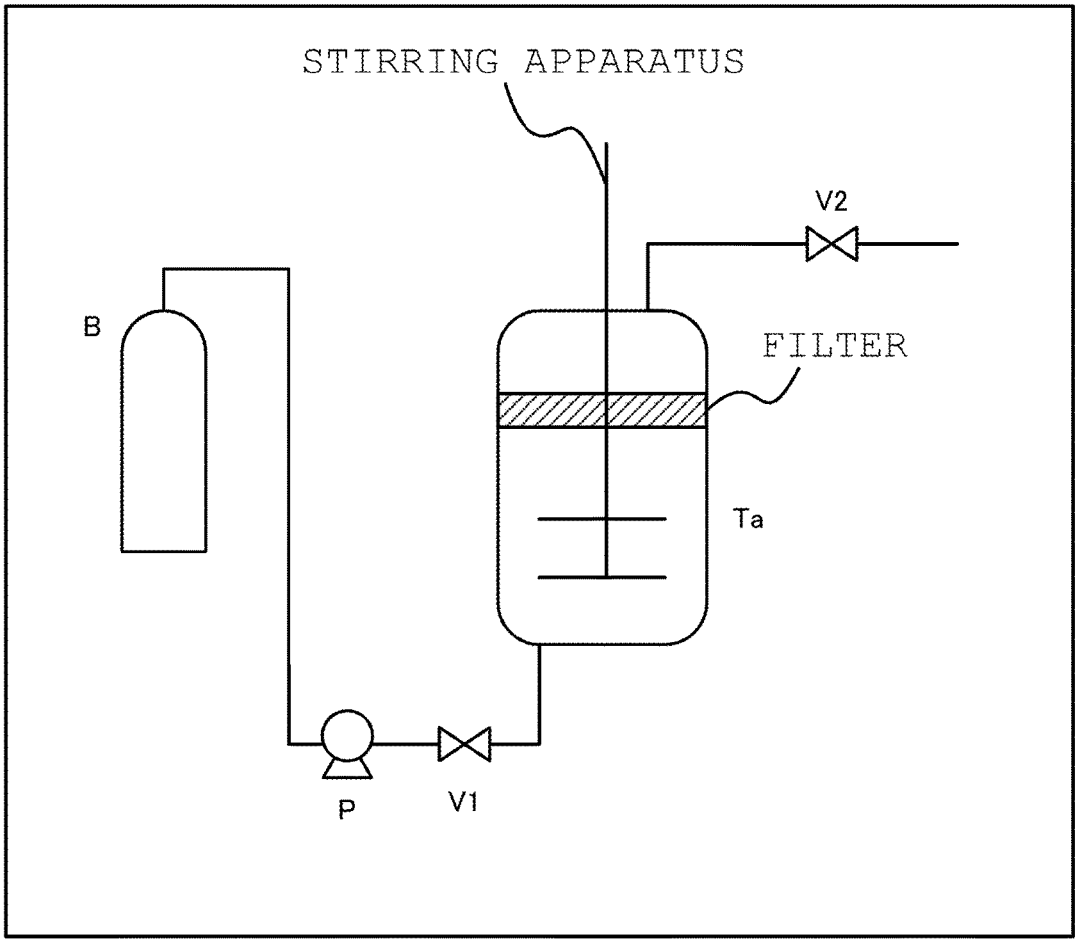
STIRRING APPARATUS
V2
B
FILTER
Ta
P
V1

TONER AND METHOD OF PRODUCING TONER

BACKGROUND OF THE INVENTION

Field of the Invention

The present invention relates to a toner used to form a toner image by the development of an electrostatic latent image formed by a method such as, e.g., electrophotography, electrostatic recording, or toner jet recording, and the present invention further relates to a method of producing this toner.

Description of the Related Art

Achieving greater energy savings has been regarded in recent years as a major technical issue for copiers, printers, and facsimile machines, and there is desire for a substantial reduction in the amount of heat applied by the image-fixing apparatus. Accordingly, there is increasing need for the toner to have what is known as "low-temperature fixability", which enables fixing of the image to be carried out with less energy.

A general method for improving the low-temperature fixability of toners is to lower the glass transition temperature (Tg) of the binder resin used. However, when simply just the Tg of the binder resin is reduced, due to a deficient releasability at low temperatures, cold offset to the fixing member ends up being produced prior to the appearance of the viscosity reduction effect due to the reduction in Tg. In order to suppress this, the outmigration of the release agent, e.g., wax, to the toner surface during fixing must be sped up. However, when this is achieved using a wax having a lower melting point, the occurrence of outmigration by the wax to the toner surface during storage is also facilitated at the same time that outmigration during fixing is sped up, and thus coexistence with the heat-resistant storability is problematic.

Thus, in order to avoid this adverse effect, efforts have been made to improve wax outmigration by controlling the state of its dispersion in the toner, but without lowering the melting point of the wax.

A method is disclosed in Japanese Patent Application Laid-open No. 2013-228707 that uses a wax dispersing agent to improve the dispersibility of a hydrocarbon wax in a polyester resin. While hydrocarbon waxes have a low compatibility with polyester resins, the dispersibility of the wax is improved by the use of a wax dispersing agent. With this method, a large amount of wax is necessarily present in the vicinity of the toner surface, and as a consequence outmigration by the wax to the toner surface is facilitated and the low-temperature fixability is then improved.

A method is disclosed in Japanese Patent Application Laid-open No. 2011-43696 in which, in the emulsion aggregation method, which is a method that carries out toner production in an aqueous medium, wax is dispersed in a toner that uses a styrene-acrylic binder.

In Japanese Patent Application Laid-open No. 2008-276269, a toner is disclosed wherein wax is dispersed in the toner and the state of its distribution is not uniform, but rather it is present in larger amounts in the vicinity of the surface. With this method, additional improvements in the low-temperature fixability can be expected because the wax can more easily outmigrate to the toner surface.

SUMMARY OF THE INVENTION

However, the method in Japanese Patent Application Laid-open No. 2013-228707 is applicable to toner production by what is known as a pulverization method, in which the toner particle is obtained by carrying out pulverization after the toner starting materials have been mixed and kneaded. Due to this, it has not been possible to introduce large amounts of wax in other toner production methods, which has been unsatisfactory from the standpoint of the hot offset resistance on the high temperature side.

In the method of Japanese Patent Application Laid-open No. 2011-43696, the state of the wax is a uniformly dispersed state and the problem identified above again is not solved.

With the method of Japanese Patent Application Laid-open No. 2008-276269, the problem identified above is also not solved, but in addition, due to a reduction in the amount of wax present in the vicinity of the center of the toner, the extent of deformation of the toner as a whole due to melting by the wax during heating and fixing is then poor and as a consequence the negative effect appears of a reduction in the gloss of the obtained image.

As indicated in the preceding, a toner has yet to appear that exhibits an improved low-temperature fixability achieved through control of the state of the wax and that exhibits coexistence between a high gloss and a satisfactory hot offset resistance.

The present invention provides a toner that solves the existing problem described above. That is, an object of the present invention is to provide a toner that, due to an improved outmigration by the wax to the toner surface, exhibits an excellent releasability during low-temperature fixing and that can avoid offset during high-temperature fixing and can provide a high-gloss fixed image.

The aforementioned problem is solved by the present invention, which is described in the following.

The toner of the present invention comprises a toner particle that contains a binder resin and a wax, wherein in a cross sectional image of the toner observed with a transmission electron microscope, the toner satisfies the following formulas (1) and (2)

$$18.0\% \geq As \geq 1.5\% \quad (1)$$

$$10.0 \geq Ac/As \geq 2.0 \quad (2)$$

where As represents the proportion for the area taken up by the wax present in the surface layer region relative to the area of the surface layer region, the surface layer region having distance 1.0 μm in the radial direction inward from the surface of the toner, and Ac represents the proportion for the area taken up by the wax present in the inner region relative to the area of the inner region, the inner region positioned further inside than the surface layer region.

In addition, the present invention relates to a method of producing a toner that comprises a toner particle that contains a binder resin and a wax, wherein the toner production method contains a following exposure treatment step (A) or (B):

(A) a step of obtaining a toner particle by exposing a pretreatment toner particle containing the binder resin and the wax to carbon dioxide, (B) a step of obtaining a toner by exposing a pretreatment toner containing an external additive and a toner particle containing the binder resin and the wax to carbon dioxide, wherein a temperature of the carbon dioxide in the exposure treatment step is at least 10° C. and not more than 60° C. and a pressure thereof is at least 1.0 MPa and not more than 3.5 MPa, and when a cross sectional image of the toner yielded through the exposure treatment step is observed using a transmission electron microscope, the following formula (1) is satisfied $$18.0\% \geq As \geq 1.5\% \quad (1)$$

where As represents the proportion for the area taken up by the wax present in the surface layer region relative to the area of the surface layer region, the surface layer region having distance 1.0 μm in the radial direction inward from the surface of the toner.

Further features of the present invention will become apparent from the following description of exemplary embodiments (with reference to the attached drawings).

BRIEF DESCRIPTION OF THE DRAWINGS

FIG. 1 is an example of a treatment apparatus used for treatment with carbon dioxide.

DESCRIPTION OF THE EMBODIMENTS

In the present invention, a specific range is established for the toner surface layer region for the distribution of the wax abundance in the toner and in addition a specific range is established for the ratio of the wax abundance between this surface layer region and the region outside the surface layer region (the inner region). By doing this, a toner can be obtained for which outmigration by the wax during fixing is facilitated, to which an amount of wax sufficient for obtaining releasability during high-temperature fixing can be added while maintaining an excellent low-temperature fixability, and with which a high-gloss toner image can be formed.

The state of the wax in the toner can be confirmed by observation of the toner cross section using a transmission electron microscope. The ratio for the wax abundance can be specified by the ratio between the proportion for the area of the wax present in the surface layer region relative to the area of the surface layer region and the proportion for the area of the wax present in the inner region to the area of the inner region where the inner region excludes the surface layer region and contains the center of the toner.

The toner of the present invention is specifically described below, but is not limited to or by this.

The present invention can be applied to toner produced by any method, but its effects are prominently obtained when it is applied to wet production methods in which the toner particle is produced by granulation of a toner starting material in an aqueous medium (for example, a suspension polymerization method or solution suspension method). As an example, the steps will be described for a suspension polymerization production method, in which the toner particle is produced by the granulation in an aqueous medium of a composition that contains polymerizable monomer.

(Step of Preparation of a Polymerizable Monomer Composition)

The polymerizable monomer that will constitute the binder resin, wax, and optionally a colorant are mixed to prepare a polymerizable monomer composition. The colorant may be mixed with a separate composition after it has been preliminarily dispersed in polymerizable monomer or organic solvent using, for example, a stirred media mill, or it may be dispersed after the entire composition has been mixed. A polar resin, pigment dispersing agent, charge control agent, and so forth may also be added as appropriate to this polymerizable monomer composition on an optional basis.

(Polymerizable Monomer Composition Dispersion Step (Granulation Step))

An aqueous medium containing a dispersion stabilizer is prepared and is introduced into a stirred tank equipped with a stirrer that develops a high shear force; to this is added the polymerizable monomer composition; and dispersion thereof is carried out by stirring to form droplets of the polymerizable monomer composition.

(Polymerization Step)

The polymerizable monomer in the thusly obtained droplets of the polymerizable monomer composition is polymerized to obtain a resin particle dispersion. The binder resin is produced by this polymerization of the polymerizable monomer. A common stirred tank capable of temperature adjustment can be used in the polymerization step in the present invention.

The polymerization temperature is generally at least 40° C. and is preferably at least 50° C. and not more than 90° C. The polymerization temperature may be constant throughout, or the temperature may be raised in the latter half of the polymerization step with the goal of obtaining a desired molecular weight distribution. The stirring impeller used for stirring may be any stirring impeller capable of maintaining a uniform temperature within the tank and bringing about suspension without stagnation of the resin particle dispersion.

(Volatile Component Removal Step)

A volatile component removal step may be carried out in order to remove, for example, unreacted polymerizable monomer, from the resin particle dispersion after completion of the polymerization step. The volatile component removal step is carried out by heating and stirring the resin particle dispersion in a stirred tank equipped with a stirring means. The heating conditions in the volatile component removal step are adjusted as appropriate considering the vapor pressure of the component to be removed, e.g., the polymerizable monomer. The volatile component removal step may be carried out at normal pressure or under reduced pressure.

(Solid-Liquid Separation Step, Washing Step, and Drying Step)

The toner particle dispersion may be treated with acid or alkali with the goal of removing the dispersion stabilizer attached to the toner particle surface. After removal of the dispersion stabilizer from the toner particle, the toner particle is separated from the aqueous medium using a common solid-liquid separation procedure; however, in order to completely remove the acid or alkali and dispersion stabilizer dissolved therein, preferably water is added again and the toner particle is washed. This washing step may be repeated any number of times and, once thorough washing has been performed, solid-liquid separation can be carried out again to obtain the toner particle. As necessary the obtained toner particle may be dried using a known drying means.

(External Addition Step)

An external additive may be added to the obtained toner particle with the goal of improving the flowability, charging behavior, caking resistance, and so forth. The external addition step is carried out by introducing the external additive and toner particle into a stirring apparatus provided with a high-speed impeller and thoroughly mixing.

The weight-average particle diameter of the obtained toner is preferably at least 4 μm and not more than 10 μm and is more preferably at least 5 μm and not more than 8 μm. When the weight-average particle diameter of the toner is in this range, the distribution of the wax is then readily maintained in the desired state and an impairment of the low-temperature fixability due to the particle diameter can also be suppressed, and this is thus preferred. The weight-average particle diameter of the toner can be control using the amount of addition of the dispersion stabilizer that is used in the granulation step.

When, on the other hand, the toner particle is obtained by a solution suspension method, a resin solution is prepared by the dissolution or dispersion to uniformity, in an organic solvent, of the binder resin and wax and optionally other materials such as a polar resin, colorant, charge control agent, and so forth. The obtained resin solution is dispersed and granulated in an aqueous medium, and the organic solvent present in the granulated particle is removed to obtain a toner particle having a desired particle diameter. The obtained toner particle can be subjected to a washing step, drying step, and external addition step using the same methods as in the suspension polymerization method described above.

The organic solvent used in the resin solution in the solution suspension method should be compatible with the starting materials for the toner particle, e.g., the binder resin, wax, and so forth, but is not otherwise particularly limited. However, viewed from the standpoint of solvent removal, an organic solvent that has a certain vapor pressure even at not more than the boiling point of water is preferred. For example, toluene, xylene, ethyl acetate, butyl acetate, methyl ethyl ketone, or methyl isobutyl ketone can be used.

The exposure treatment step using carbon dioxide is described in the following.

(Carbon Dioxide Treatment Step)

The carbon dioxide treatment step contains a carbon dioxide exposure treatment step carried out on either or both of the following (i) and (ii). The treatment procedure is the same in the case of either.

(i) a toner particle obtained after a solid-liquid separation step or after a drying step (pretreatment toner particle containing binder resin and wax)

(ii) a toner obtained after an external addition step (pretreatment toner containing an external additive and a toner particle containing binder resin and wax)

In the following, (i) is referred to as the pretreatment toner particle; (ii) is referred to as the pretreatment toner; (i) after its exposure treatment by a step as described below is referred to as the post-treatment toner particle; and (ii) after its exposure treatment by a step as described below is referred to as the post-treatment toner. In addition, when reference is made simply to a toner particle or a toner, no pretreatment/post-treatment distinction is being made. An external additive may be added, after the treatment step, to the post-treatment toner particle yielded by the following carbon dioxide exposure treatment step carried out on (i).

The carbon dioxide exposure treatment step contains the following exposure treatment step (A) or (B):

(A) a step of obtaining a toner particle by exposing a pretreatment toner particle to carbon dioxide, (B) a step of obtaining a toner by exposing a pretreatment toner to carbon dioxide.

The treatment apparatus used in the carbon dioxide treatment in the production method of the present invention should be capable of adjustment to a prescribed pressure and temperature, but is not otherwise particularly limited. The exposure treatment method is described in the following based on an example of a treatment apparatus as shown in FIG. 1.

The pressurized holding tank Ta of the treatment apparatus shown in FIG. 1 is provided with a filter that prevents the post-treatment toner particle or post-treatment toner from flowing out to the outside of the tank Ta together with the carbon dioxide when the carbon dioxide is released to the outside via the backpressure valve V2. The tank Ta also has a stirring mechanism for mixing.

In the carbon dioxide treatment, first the pretreatment toner particle or pretreatment toner is introduced into the tank Ta, which has been adjusted to a prescribed temperature, and stirring is carried out. The valve V1 is then opened and carbon dioxide is introduced, from a container B that stores carbon dioxide, into the tank Ta in a compressed state using the compression pump P. Once the prescribed pressure has been reached, the pump is stopped and the valve V1 is closed; the interior of the tank Ta is brought into a sealed condition; and holding at pressure for a prescribed period of time is carried out. Once the prescribed holding period has elapsed, the valve V2 is released and the carbon dioxide is discharged to the outside of the tank Ta and the pressure in the tank Ta is dropped to atmospheric pressure. This process—i.e., bringing the pretreatment toner particle or the pretreatment toner into contact with carbon dioxide by holding at pressure after the introduction of carbon dioxide and then releasing the carbon dioxide after the treatment—may also be carried out two or more times.

The temperature of the carbon dioxide in the production method of the present invention is at least 10° C. and not more than 60° C. and is preferably at least 15° C. and not more than 55° C. Having the temperature be in this range facilitates dissolution of the wax by the permeated carbon dioxide and facilitates diffusion of the wax in the binder resin, as a consequence of which the wax-dispersing effect of the present invention is obtained. An excellent low-temperature fixability can be obtained as a result. In addition, when the temperature is in this range, melt adhesion between post-treatment toner particles and melt adhesion of the post-treatment toner with itself can be suppressed.

The pressure of the carbon dioxide in the production method of the present invention is at least 1.0 MPa and not more than 3.5 MPa and is preferably at least 1.5 MPa and not more than 3.0 MPa. By having the pressure be in the indicated range, the carbon dioxide then satisfactorily permeates into the toner particle or toner and readily reaches to the wax in the interior of the toner particle or toner. As a consequence, the wax-dispersing effect of the present invention is obtained and an excellent low-temperature fixability can be obtained. In addition, when the pressure is in this range, melt adhesion between post-treatment toner particles and melt adhesion of the post-treatment toner with itself can be suppressed.

The carbon dioxide may be used by itself in the production method of the present invention or it may be used mixed with another gas. In the case of use mixed with another gas, the partial pressure of the carbon dioxide should be at least 1.0 MPa and not more than 3.5 MPa.

The time for the carbon dioxide treatment step (exposure treatment step) is preferably at least 5 minutes and more preferably is at least 30 minutes. By carrying out the treatment for at least 5 minutes, the wax can be thoroughly diffused into the binder resin and the wax distribution can be brought into a favorable state. In addition, when the carbon dioxide treatment step is carried out over an extended period of time, an excessive amount of wax comes to be present in the vicinity of the surface layer of the post-treatment toner particle or post-treatment toner and the charging behavior and durability assume a declining trend, and as a consequence not more than 180 minutes is preferred and not more than 150 minutes is more preferred.

The state of the wax distribution in the toner particle can be controlled by this carbon dioxide exposure treatment. The desired state for the wax distribution in the toner particle can be brought about by using an appropriate temperature and pressure for the carbon dioxide and an appropriate contact time.

The state of the wax distribution can be identified by observation of the toner cross section. Here, a state is preferred in which a plurality of domains showing the wax are observed in the surface layer region extending to 1.0 μm from the surface of the toner. The low-temperature fixability is even better when the wax assumes such a state. A state in which a plurality of domains showing the wax are observed refers to a state, in the determination of Ac and As as described below, in which at least 5 domains having a long axis of 0.05 μm to 1.00 μm are present in at least 6 of 10 toner cross sections.

The carbon dioxide exposure treatment is specifically included in order to bring about the presence of a plurality of wax domains in the surface layer region.

In observation of the toner cross sectional image, and designating As as the proportion for the area taken up by the wax present in the surface layer region relative to the area of the surface layer region, the surface layer region having distance 1.0 μm in the radial direction inward from the toner surface, As is at least 1.5% and not more than 18.0%. Due to an enhanced wax outmigration when As is in this range, an excellent low-temperature fixability is obtained and in addition there are no adverse effects on the heat-resistant storability and developing performance. A more preferred range for As is at least 2.0% and not more than 15.0%, while at least 2.5% and not more than 11.0% is even more preferred. This As can be controlled using, for example, the conditions in the carbon dioxide treatment step. For example, the value of As is increased by raising the temperature of the carbon dioxide, increasing the pressure of the carbon dioxide, and extending the treatment time.

In addition, designating Ac as the proportion for the area taken up by the wax present in the inner region relative to the area of the inner region, the inner region positioned further inside than the surface layer region, Ac/As is at least 2.0 and not more than 10.0 and is preferably at least 3.0 and not more than 8.0. When Ac/As is in this range, more wax will then be present in the center region of the toner while an amount of wax sufficient for low-temperature fixing will be present in the vicinity of the surface layer. As a consequence, an excellent offset resistance is obtained on the high temperature side and the image strength is increased because a satisfactory adherence is obtained between the paper and the fixed toner image. In addition, the gloss of the obtained image is enhanced due to a promotion of deformation of the toner as a whole brought about by melting of the wax in the toner central region during fixing. The inner region residing to the inside of the surface layer region, which itself extends to 1.0 μm from the toner surface, is the region in the toner cross section that contains the toner center and that resides to the inside at a distance greater than 1.0 μm from the toner surface in the inward radial direction. That is, it is the region in the toner cross section exclusive of the surface layer region. This Ac can be controlled using, for example, the amount of wax addition to the toner. For example, Ac is increased when the amount of wax addition is increased.

Materials that can be used in the toner particle are specifically described in the following by way of example, but there is no limitation to or by these.

A known resin can be used for the binder resin.

Specific examples are vinyl resins, polyester resins, polyamide resins, furan resins, epoxy resins, xylene resins, and silicone resins. A single one of these resins can be used by itself or a mixture of these resins can be used. The homopolymers and copolymers of the following monomers can be used for the vinyl resin: styrenic monomers as typified by styrene, α-methylstyrene, and divinylbenzene; unsaturated carboxylate esters as typified by methyl acrylate, butyl acrylate, methyl methacrylate, 2-hydroxyethyl methacrylate, t-butyl methacrylate, and 2-ethylhexyl methacrylate; unsaturated carboxylic acids as typified by acrylic acid and methacrylic acid; unsaturated dicarboxylic acids as typified by maleic acid; unsaturated dicarboxylic acid anhydrides as typified by maleic anhydride; and nitrile-type vinylic monomers as typified by acrylonitrile.

Among these binder resins, styrene-acrylic resins, which are produced from styrenic monomer and acrylic monomer (the unsaturated carboxylate ester and/or unsaturated carboxylic acid), are preferred from the standpoint of the durability and developing characteristics of the toner. The ratio between the styrenic monomer and acrylic monomer may be adjusted considering the glass transition temperature desired for the binder resin and toner particle. The content of the styrene-acrylic resin in the binder resin is preferably at least 50 mass % and not more than 100 mass and is more preferably at least 80 mass % and not more than 100 mass %.

Various polymerization initiators, e.g., peroxide polymerization initiators, azo polymerization initiators, and so forth, can be used for the polymerization initiator used in the production of the binder resin and toner particle.

Usable peroxide polymerization initiators can be exemplified by organic types such as peroxy esters, peroxy dicarbonates, dialkyl peroxides, peroxy ketals, ketone peroxides, hydroperoxides, and diacyl peroxides.

The inorganic types can be exemplified by persulfates and hydrogen peroxide. Specific examples are peroxy esters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butylperoxy isopropyl monocarbonate, and t-butylperoxy 2-ethylhexyl monocarbonate; diacyl peroxides such as benzoyl peroxide; peroxydicarbonates such as diisopropyl peroxydicarbonate; peroxy ketals such as 1,1-di-t-hexylperoxy cyclohexane; dialkyl peroxides such as di-t-butyl peroxide; as well as t-butylperoxy allyl monocarbonate.

Usable azo polymerization initiators can be exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and dimethyl 2,2'-azobis(2-methylpropionate).

As necessary two or more of these polymerization initiators may also be used at the same time. The use amount of the polymerization initiator used here is preferably at least 0.10 mass parts and not more than 20.0 mass parts per 100.0 mass parts of the polymerizable monomer.

The acid value of the binder resin is preferably at least 0.0 mg KOH/g and not more than 15.0 mg KOH/g and is more preferably at least 0.0 mg KOH/g and not more than 8.0 mg KOH/g. By having the acid value be not more than 15.0 mg KOH/g, permeation of the carbon dioxide into the binder resin is facilitated and obtaining the wax-dispersing effect is facilitated.

The weight-average molecular weight (Mw) of the binder resin is preferably at least 10,000 and not more than 50,000 and is more preferably at least 12,000 and not more than 45,000. By having this be at least 10,000, maintenance of the state of phase separation between the binder resin and wax in the post-treatment toner particle and the post-treatment toner is facilitated and outmigration of the wax during fixing is facilitated. The effect on low-temperature fixing can be thoroughly exhibited as a result. In addition, by having this be not more than 50,000, permeation by the carbon dioxide into the binder resin is facilitated and the wax-dispersing effect can be satisfactorily obtained.

In addition, a resin provided by the polymerization of a radical-polymerizable vinylic polymerizable monomer as described below can be used as the binder resin. Such a polymerizable monomer is preferred for the suspension polymerization method. A monofunctional polymerizable monomer or a polyfunctional polymerizable monomer can be used as this vinylic polymerizable monomer. A monofunctional polymerizable monomer is a monomer that contains one polymerizable unsaturated group, while a polyfunctional polymerizable monomer is a monomer that contains a plural number of polymerizable unsaturated groups.

The monofunctional polymerizable monomer can be exemplified by the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxylethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

A single monofunctional polymerizable monomer may be used by itself or a combination of two or more may be used; or, a combination of monofunctional polymerizable monomer and polyfunctional polymerizable monomer may be used; or, a single polyfunctional polymerizable monomer may be used by itself or a combination of two or more may be used. Among the polymerizable monomers, the use of styrene or a styrene derivative, either individually or as a mixture or mixed with another polymerizable monomer, is preferred from the standpoint of the developing characteristics and durability of the toner.

A polar resin may also be added to the toner of the present invention. A polyester resin or a carboxyl-containing styrene resin is preferred for the polar resin. By using a polyester resin or carboxyl-containing styrene resin as the polar resin, a shell is formed through segregation of such a resin to the toner particle surface, and when this occurs the lubricity inherent to these resins can be expected.

A polyester resin provided by the condensation polymerization of an alcohol monomer and a carboxylic acid monomer is used for the polyester resin. The alcohol monomer can be exemplified by the following:

alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, and also ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanethiol, 2-methyl-1,2,4-butanetriol, trimethylolethane, trimethylolpropane, and 1,3,5-trihydroxymethylbenzene.

The carboxylic acid monomer, on the other hand, can be exemplified by the following:

aromatic dicarboxylic acids such as phthalic acid, isophthalic acid, and terephthalic acid, and their anhydrides; alkyldicarboxylic acids such as succinic acid, adipic acid, sebacic acid, and azelaic acid, and their anhydrides; succinic acid substituted by a $C_{6-18}$ alkyl group or alkenyl group, and anhydrides thereof; and unsaturated dicarboxylic acids such as fumaric acid, maleic acid, and citraconic acid, and anhydrides thereof.

The following monomers may also be used in addition to the preceding:

polyhydric alcohols such as glycerol, sorbitol, sorbitan, and, for example, the oxyalkylene ethers of novolac-type phenolic resins; also, polybasic carboxylic acids such as trimellitic acid, pyromellitic acid, and benzophenonetetracarboxylic acid, and anhydrides thereof.

The following are preferred in particular among the preceding for their excellent charging characteristics: resins provided by the condensation polymerization of a polyester unit component in which a bisphenol derivative represented by the following general formula (3) is a dihydric alcohol monomer component and an at least dibasic carboxylic acid component is an acid monomer component. A carboxylic acid or anhydride thereof or lower alkyl ester thereof can be used as the at least dibasic carboxylic acid component. Examples here are fumaric acid, maleic acid, maleic anhydride, phthalic acid, terephthalic acid, trimellitic acid, and pyromellitic acid.

(3)

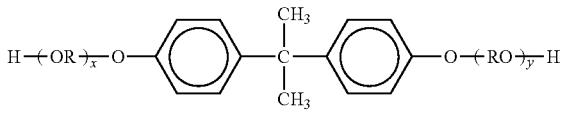

(In the formula, R represents an ethylene group or propylene group; x and y are each an integer at least 1; and the average value of x+y is 2 to 10.)

For example, styrene-acrylic acid copolymers, styrene-methacrylic acid copolymers, and styrene-maleic acid copolymers are preferred for the carboxyl group-containing styrene resin. In particular, styrene-acrylate ester-acrylic acid copolymers are preferred because they facilitate control of the amount of charge. In addition, the carboxyl group-containing styrene resin more preferably contains a monomer that has a primary or secondary hydroxyl group. The polymer composition can be specifically exemplified by styrene-2-hydroxyethyl methacrylate-methacrylic acid-methyl methacrylate copolymers, styrene-n-butyl acrylate-2-hydroxyethyl methacrylate-methacrylic acid-methyl methacrylate copolymers, and styrene-α-methylstyrene-2-hydroxyethyl methacrylate-methacrylic acid-methyl methacrylate copolymers. A resin containing a monomer having a primary or secondary hydroxyl group has a high polarity and provides a better long-term storage stability.

The content of the polar resin, per 100.0 mass parts of the binder resin or the polymerizable monomer constituting the binder resin, is preferably at least 1.0 mass part and not more than 20.0 mass parts and is more preferably at least 2.0 mass parts and not more than 10.0 mass parts.

A colorant may be incorporated in the toner of the present invention. A known colorant, e.g., the various heretofore known dyes and pigments, can be used as this colorant.

The black colorant may be a carbon black, a magnet body, or black colorant provided by color mixing to yield black using the yellow/magenta/cyan colorants described in the following.

Compounds as typified by, for example, monoazo compounds, disazo compounds, condensed azo compounds, isoindolinone compounds, anthraquinone compounds, azo-metal complexes, methine compounds, and allylamide compounds may be used as the yellow colorant. Specific examples are C.I. Pigment Yellow 74, 93, 95, 109, 111, 128, 155, 174, 180, and 185.

For example, monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds may be used as the magenta colorant. Specific examples are C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 and C.I. Pigment Violet 19.

For example, copper phthalocyanine compounds and derivatives thereof, anthraquinone compounds, and basic dye lake compounds can be used as the cyan colorant. Specific examples are C.I. Pigment Blue 1, 7, 15, 15:1, 15:2, 15:3, 15:4, 60, 62, and 66.

A magnetic body may be incorporated in the toner particle when the toner of the present invention is used as a magnetic toner. In this case the magnetic body can also assume the role of a colorant. This magnetic body can be exemplified by iron oxides such as magnetite, hematite, and ferrite and by metals such as iron, cobalt, and nickel. Or, this magnetic body can be exemplified by alloys and mixtures of these metals with metals such as aluminum, cobalt, copper, lead, magnesium, tin, zinc, antimony, beryllium, bismuth, cadmium, calcium, manganese, selenium, titanium, tungsten, and vanadium.

The colorant is selected considering the hue angle, chroma, lightness, lightfastness, OHP transparency, and dispersibility in the toner particle. A single colorant or a mixture of colorants may be used, and the colorant can be used in the form of a solid solution. The colorant is preferably used at at least 1.0 mass part and not more than 20.0 mass parts per 100.0 mass parts of the binder resin or the polymerizable monomer constituting the binder resin.

A known wax can be used without particular limitation as the wax used in the present invention. The following compounds are examples: aliphatic hydrocarbon waxes, e.g., low molecular weight polyethylene, low molecular weight polypropylene, microcrystalline wax, paraffin wax, and Fischer-Tropsch waxes; oxides of aliphatic hydrocarbon waxes, such as oxidized poly ene wax, and their block copolymers; waxes in which the major component is fatty acid ester, such as carnauba wax, sasol wax, ester wax, and montanic acid ester waxes; waxes provided by the partial or complete deacidification of fatty acid esters, such as deacidified carnauba wax; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained by, for example, the hydrogenation of plant oils.

The wax preferably contains a hydrocarbon wax in the present invention. Hydrocarbon waxes have the following characteristic features: they have a good solubility during the aforementioned carbon dioxide treatment; the wax readily diffuses in the binder resin; and they readily outmigrate to the toner surface during fixing. They can be exemplified by aliphatic hydrocarbon waxes, e.g., low molecular weight polyethylene, low molecular weight polypropylene, microcrystalline wax, paraffin wax, and Fischer-Tropsch waxes; oxides of aliphatic hydrocarbon waxes, such as oxidized polyethylene wax, and their block copolymers; and waxes provided by grafting an aliphatic hydrocarbon wax using a vinylic monomer such as styrene or acrylic acid.

The content of the wax (preferably hydrocarbon wax) is preferably at least 1.0 mass part and not more than 20.0 mass parts per 100 mass parts of the binder resin or 100 mass parts of the polymerizable monomer constituting the binder resin. At least 1.5 mass parts and not more than 15.0 mass parts is more preferred. When the wax content is in this range, a satisfactory low-temperature fixability and high-temperature fixability are obtained and the image strength is also enhanced because a satisfactory adherence between the paper and the fixed toner image is obtained.

The melting point of the wax is preferably in the range of at least 30° C. and not more than 130° C. and more preferably in the range of at least 60° C. and not more than 100° C. By using a wax that exhibits such a thermal characteristic, not only does the obtained toner have an excellent fixing performance, but the wax-mediated releasing effect is efficiently manifested and a satisfactory fixing region is secured.

The solubility parameter SP1 of the binder resin and the solubility parameter SP2 of the wax preferably satisfy the following formula (3).

$$|SP1-SP2| \geq 1.10 \quad (3)$$

When the difference in the SP values is in this range, excessive compatibilization of the wax into the binder resin can be suppressed and outmigration of the wax to the toner surface is promoted. |SP1−SP2| is more preferably at least 1.20 and not more than 1.80.

A charge control agent may be used in the toner particle. The use is preferred thereamong of a charge control agent that controls the toner particle to negative charging. Examples of this charge control agent are provided in the following.

Examples are organometal compounds, chelate compounds, monoazo metal compounds, acetylacetone metal compounds, urea derivatives, metal-containing salicylic acid compounds, metal-containing naphthoic acid compounds, quaternary ammonium salts, calixarene, silicon compounds, and metal-free carboxylic acid compounds and their derivatives. Sulfonic acid resins having a sulfonic acid group, sulfonate salt group, or sulfonate ester group are also preferably used.

The negative-charging charge control agents can be specifically exemplified by the following: metal compounds of aromatic carboxylic acids as typified by salicylic acid, alkylsalicylic acid, dialkylsalicylic acid, naphthoic acid, and dicarboxylic acids; polymers and copolymers that have a sulfonic acid group, sulfonate salt group, or sulfonate ester group; metal salts and metal complexes of azo dyes and azo pigments; boron compounds; silicon compounds; and calixarene.

The positive-charging charge control agents, on the other hand, can be exemplified by the following: quaternary ammonium salts and polymeric compounds that have a quaternary ammonium salt in side chain position; guanidine compounds; nigrosine compounds; and imidazole compounds.

The following can be used as the polymers and copolymers that have a sulfonic acid group, sulfonate salt group, or sulfonate ester group: homopolymers of a sulfonic acid group-containing vinylic monomer, e.g., styrenesulfonic acid, 2-acrylamido-2-methylpropanesulfonic acid, 2-methacrylamido-2-methylpropanesulfonic acid, vinylsulfonic acid, and methacrylsulfonic acid; and copolymers of the preceding sulfonic acid group-containing vinylic monomer with the vinylic monomer as indicated above for the binder resin.

The amount of charge control agent addition, per 100.0 mass parts of the binder resin or polymerizable monomer constituting the binder resin, is preferably at least 0.01 mass parts and not more than 20.0 mass parts, more preferably at least 0.1 mass parts and not more than 10.0 mass parts, and even more preferably at least 0.5 mass parts and not more than 10.0 mass parts.

An external additive is preferably added to the toner particle in the toner of the present invention in order to improve the image quality. Silicic acid fine particles and inorganic fine particles of, e.g., titanium oxide, aluminum oxide, and so forth, are favorably used as this external additive. These inorganic fine particles are preferably subjected to a hydrophobic treatment with a hydrophobic agent, e.g., a silane coupling agent, silicone oil, or their mixture. This external additive is used, per 100.0 mass parts of the toner particle, preferably at at least 0.1 mass parts and not more than 5.0 mass parts and more preferably at at least 0.1 mass parts and not more than 3.0 mass parts.

A known surfactant or organic dispersing agent or inorganic dispersing agent can be used as a dispersion stabilizer that is added to the aqueous medium. Inorganic dispersing agents also suppress stability disruptions due to the polymerization temperature or passage of time and they are also easily washed out thereby suppressing negative effects on the toner, and as a consequence inorganic dispersing agents can be favorably used among the preceding. The inorganic dispersing agent can be exemplified by the following: multivalent metal salts of phosphoric acid, such as tricalcium phosphate, magnesium phosphate, aluminum phosphate, and zinc phosphate; carbonate salts such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina. After the completion of the polymerization, these inorganic dispersing agents can be almost completely removed by decomposition through the addition of acid or alkali.

The methods for calculating and measuring the various property values stipulated for the present invention are described in the following.

<Method for Calculating the Solubility Parameter (SP Value)>

The SP value in the present invention was determined using equation (1) according to Fedors. Here, for the values of Δei and Δvi, reference was made to "Energies of Vaporization and Molar Volumes (25° C.) of Atoms and Atomic Groups" in Table 3-9 of *Kotingu no Kiso Kagaku* (Basic Coating Science) (pp. 54-57, 1986 (Maki Shoten Publishing)). The unit for the SP value is $(cal/cm^3)^{1/2}$ but conversion to the $(J/m^3)^{1/2}$ unit can be carried out using $1\ (cal/cm^3)^{1/2}=2.046\times10^3\ (J/m^3)^{1/2}$.

$$\delta i=(Ev/V)^{1/2}=(\Delta ei/\Delta vi)^{1/2} \quad \text{equation (1)}$$

Ev: energy of vaporization

V: molar volume

Δei: energy of vaporization of the atoms or atomic groups of component i

Δvi: molar volume of the atoms or atomic groups of component i (Separation of the Binder Resin and Wax from the Toner)

The toner is dissolved in tetrahydrofuran (THF) and the solvent is distilled from the obtained soluble matter under reduced pressure to obtain the THF-soluble component of the toner.

The obtained THF-soluble component of the toner is dissolved in chloroform to prepare a sample solution having a concentration of 25 mg/mL.

3.5 mL of the obtained sample solution is injected into the instrument indicated below and number-average molecular weights (Mn) of at least 2,000 are fractionated as the binder resin component and number-average molecular weights (Mn) less than 2,000 are fractioned as the wax component.

preparative GPC instrument: Preparative HPLC Model LC-980 from Japan Analytical Industry Co., Ltd.

preparative column: JAIGEL 3H, JAIGEL 5H (from Japan Analytical Industry Co., Ltd.)

eluent: chloroform flow rate: 3.5 mL/minute

A calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", from Tosoh Corporation) is used for the determination of the molecular weight of the sample.

After the fractionation of the individual components, the solvent is distilled off under reduced pressure and drying is carried out for 24 hours under reduced pressure in a 90° C. atmosphere. This procedure is repeated until about 100 mg of each component is obtained.

(Determination of the Structures of the Binder Resin and Wax)

The structures of the binder resin and wax were determined using nuclear magnetic resonance spectroscopy ($^1$H-NMR) [400 MHz, $CDCl_3$, room temperature (25° C.)].

measurement instrumentation: JNM-EX400 FT-NMR instrument (from JEOL Ltd.)
measurement frequency: 400 MHz
pulse condition: 5.0 μs
frequency range: 10,500 Hz
number of integrations: 64

The SP value of the binder resin or wax is determined based on the structure identified in this manner and using the method for calculating the solubility parameter described above.

<Method for Measuring the Acid Value of the Binder Resin>

The acid value is the number of milligrams of potassium hydroxide required to neutralize the acid present in 1 g of a sample. The acid value in the present invention is measured based on JIS K 0070-1992, and in specific terms the measurement is carried out according to the following procedure.

The titration is run using a 0.1 mol/L ethanolic potassium hydroxide solution (from Kishida Chemical Co., Ltd.). The factor for this ethanolic potassium hydroxide solution can be determined using a potentiometric titration apparatus (AT-510 potentiometric titrator). 100 mL of 0.1 mol/L hydrochloric acid is introduced into a 250-mL tall beaker and is titrated with the ethanolic potassium hydroxide solution and the factor is determined from the amount of the ethanolic potassium hydroxide solution required for neutralization. The 0.1 mol/L hydrochloric acid used is prepared based on JIS K 8001-1998.

The measurement conditions during measurement of the acid value are given below.
titration instrument: AT-510 potentiometric titration apparatus (from Kyoto Electronics Manufacturing Co., Ltd.)
electrode: composite glass electrode, double junction type (from Kyoto Electronics Manufacturing Co., Ltd.)
titrator control software: AT-WIN
titration analysis software: Tview The titration is carried out using the following titration parameters and control parameters.
Titration Parameters
titration mode: blank titration
titration form: full titration
maximum titration volume: 20 mL
wait time before titration: 30 seconds
titration direction: automatic
Control Parameters
endpoint sense potential: 30 dE
endpoint sense potential value: 50 dE/dmL
endpoint detection sensing: not set
control speed mode: standard
gain: 1
data sampling potential: 4 mV
data sampling titration volume: 0.1 mL
Main Test:

0.100 g of the measurement sample is exactly weighed into a 250-mL tall beaker and 150 mL of a toluene/ethanol (3:1) mixed solution is added and dissolution is carried out over 1 hour. Titration is performed using the above-indicated potentiometric titration apparatus and ethanolic potassium hydroxide solution.
Blank Test:

The same titration as in the above procedure is run, but without using the sample (that is, with only the toluene/ethanol (3:1) mixed solution).

The obtained results are substituted into the following equation and the acid value is calculated.

$$A=[(C-B)\times f\times 5.61]/S$$

Here, A represents the acid value (mg KOH/g); B represents the amount (mL) of addition of the potassium hydroxide solution in the blank test; C represents the amount (mL) of addition of the potassium hydroxide solution in the main test; f represents the factor for the potassium hydroxide solution; and S represents the sample (g).

In order to measure the acid value of the binder resin in the present invention, the resin was separately produced using the same conditions as in production of the toner particle, but without using the toner constituent materials besides the polymerizable monomer, and this resin was used for the sample in acid value measurement.

<Method for Measuring the Weight-Average Molecular Weight (Mw) of the Binder Resin>

The weight-average molecular weight (Mw) of the binder resin is measured using gel permeation chromatography (GPC) as follows.

First, the toner particle is dissolved in tetrahydrofuran (THF) at room temperature. The obtained solution is filtered with a "Sample Pretreatment Cartridge" (from Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.
instrument: "HLC-8220GPC" high-performance GPC instrument [from Tosoh Corporation]
column: 2×LF-604 [from Showa Denko K.K.]
eluent: THF
flow rate: 0.6 mL/minute
oven temperature: 40° C.
sample injection amount: 0.020 mL A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", from Tosoh Corporation) is used to determine the molecular weight of the sample.

In order to measure the Mw of the binder resin in the present invention, the resin was separately produced using the same conditions as in production of the toner particle, but without using the toner constituent materials besides the polymerizable monomer, and this resin was used for the sample.

<Method for Measuring the Weight-Average Particle Diameter (D4)>

The weight-average particle diameter (D4) of the toner is determined as follows. The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1,600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the above-described aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (from Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of this ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Determination of As and Ac>

For the state of wax dispersion in the toner, the toner cross section was observed using a transmission electron microscope; As and Ac were determined from the cross-sectional areas of the domains formed by the wax; and the evaluation was performed using the average value for 10 toners selected at random. Specifically, the toner was embedded with a visible light-curable embedding resin (D-800, from Nisshin EM Co., Ltd.); slicing at a thickness of 60 nm was performed using an ultrasound ultramicrotome (EM5, from Leica Biosystems); and Ru staining was carried out using vacuum staining equipment (from Filgen, Inc.). Observation was performed at an acceleration voltage of 120 kV using a transmission electron microscope (H7500, from Hitachi, Ltd.). Of the observed toner cross sections, 10 were selected that were within ±2.0 μm of the weight-average particle diameter and these were photographed. The boundaries between the wax domain regions and binder (binder resin) regions were delineated in the resulting images using image processing software (Photoshop 5.0, from Adobe).

Residual masking was performed of the surface layer region (including the boundary at 1.0 μm) residing in the toner cross section to a distance of 1.0 μm in the radial direction inward from the toner surface, and the percentage for the surface area occupied by the wax domains in the area of the surface layer region was calculated and designated as As.

In addition, the percentage was also calculated for the surface area occupied by the wax domains in the inner region (region other than the surface layer region) residing to the inside in the toner cross section from the surface layer region that extended to 1.0 μm from the toner surface, and this was designated as Ac.

The present invention can thus provide a toner that, due to an improved outmigration by the wax to the toner surface, exhibits an excellent releasability during low-temperature fixing and that can avoid offset during high-temperature fixing and can provide a high-gloss fixed image.

EXAMPLES

The present invention is specifically described below using examples, but the present invention is not limited to or by these examples. The number of parts used in the examples indicates mass parts in all instances.

<Toner Particle 1 Production>

A polymerizable monomer mixture composed of the following was prepared.

styrene 78.0 parts
n-butyl acrylate 22.0 parts
copper phthalocyanine pigment (Pigment Blue 15:3) 6.0 parts
aluminum salicylate compound 0.7 parts
(Bontron E-88: from Orient Chemical Industries Co., Ltd.)
polar resin 4.0 parts
(styrene-2-hydroxyethyl methacrylate-methacrylic acid-methyl methacrylate copolymer (mass ratio 95:2:2:3), acid value=10 mg KOH/g, glass transition point (Tg)=80° C., weight-average molecular weight (Mw)=15,000)
Fischer-Tropsch wax 9.0 parts
(HNP-51: from Nippon Seiro Co., Ltd., melting point=77° C.)

15 mm ceramic beads were introduced into this and dispersion was performed for 2 hours using a wet attritor (from Nippon Coke & Engineering Co., Ltd.) to obtain a polymerizable monomer composition 1.

In addition, 6.3 parts of sodium phosphate ($NaPO_4$) was introduced into 414.0 parts of deionized water and this was heated to 60° C. while stirring using a Clearmix (from N Technique Co., Ltd.). An aqueous calcium chloride solution of 3.6 parts of calcium chloride ($CaCl_2$) dissolved in 25.5 parts of deionized water was subsequently added and stirring was continued to prepare an aqueous medium containing a dispersion stabilizer composed of tricalcium phosphate ($Ca_3(PO_4)_2$).

10.0 parts of the polymerization initiator t-butyl peroxypivalate was added to the polymerizable monomer composition 1 and this was introduced into the aforementioned aqueous dispersion medium. A 10-minute granulation step was performed while maintaining 15,000 rpm with the Clearmix. A toner particle dispersion 1 was then obtained by carrying out polymerization for 8 hours while holding at 70° C. while stirring in a stirred tank equipped with a common stirrer.

The toner particle dispersion 1 was cooled; hydrochloric acid was then added to bring the pH to not more than 1.4 and dissolve the dispersion stabilizer; and a (pretreatment) toner particle 1 was obtained by filtration, washing, and drying.

The acid value of the binder resin in toner particle 1 was 0 mg KOH/g, and its weight-average molecular weight (Mw) was 21,000.

<Toner Particle 2 Production>

The following materials were introduced under a nitrogen atmosphere into a reaction vessel equipped with a reflux condenser, stirrer, and nitrogen inlet conduit.

| | |
|---|---|
| toluene | 100.0 parts |
| styrene | 78.0 parts |
| n-butyl acrylate | 22.0 parts |
| t-butyl peroxypivalate | 3.0 parts |

The interior of the vessel was stirred at 200 rpm, and a binder resin solution 1 was obtained by stirring for 10 hours while heating at 70° C. Then, the following components

| | |
|---|---|
| binder resin solution 1 | 160.0 parts |
| Fischer-Tropsch wax (HNP-51: from Nippon Seiro Co., Ltd., melting point = 77° C.) | 7.2 parts |
| copper phthalocyanine pigment (Pigment Blue 15:3) | 4.8 parts |
| aluminum salicylate compound (Bontron E-88: from Orient Chemical Industries Co., Ltd.) | 0.6 parts |

were mixed and dispersed for 10 hours using a wet attritor (from Nippon Coke & Engineering Co., Ltd.) loaded with 15 mm ceramic beads to obtain a resin composition solution 1.

In addition, 6.3 parts of sodium phosphate ($Na_3PO_4$) was introduced into 414.0 parts of deionized water and this was heated to 60° C. while stirring using a Clearmix (from M Technique Co., Ltd.). An aqueous calcium chloride solution of 3.6 parts of calcium chloride ($CaCl_2$) dissolved in 25.5 parts of deionized water was subsequently added and stirring was continued to prepare an aqueous medium containing a dispersion stabilizer composed of tricalcium phosphate ($Ca_3(PO_4)_2$).

The resin composition solution 1 was introduced into this aqueous dispersion medium, and a resin composition dispersion 1 was obtained by performing a 10-minute granulation step while maintaining 15,000 rpm with a Clearmix.

A toner particle dispersion 2 was obtained by removing the toluene in the resin composition dispersion 1 by raising the temperature of the resin composition dispersion 1 to 95° C. and stirring for 120 minutes.

The toner particle dispersion 2 was cooled; hydrochloric acid was then added to bring the pH to 1.4 or less and dissolve the dispersion stabilizer; and a (pretreatment) toner particle 2 was obtained by filtration, washing, and drying. The acid value of the binder resin in toner particle 2 was 0 mg KOH/g, and its weight-average molecular weight (Mw) was 23,000.

<Toner Particle 3 Production>

A (pretreatment) toner particle 3 was produced by entirely the same method as in Toner Particle 1 Production, but bringing the amount of styrene addition to 70.2 parts and the amount of n-butyl acrylate addition to 19.8 parts and also adding 10.0 parts of a crystalline polyester (1,12-dodecanediol-sebacic acid copolymer, melting point=84.2° C., weight-average molecular weight (Mw)=21,000).

The acid value of the binder resin in toner particle 3 was 0 mg KOH/g, and its weight-average molecular weight (Mw) was 21,000.

<Toner Particle 4 Production>

A (pretreatment) toner particle 4 was produced by entirely the same method as in Toner Particle 1 Production, but using 9.0 parts of behenyl behenate as an ester wax in place of the Fischer-Tropsch wax.

The acid value of the binder resin in toner particle 4 was 0 mg KOH/g, and its weight-average molecular weight (Mw) was 20,000.

<Toner Particle 5 Production>

A (pretreatment) toner particle 5 was produced by entirely the same method as in Toner Particle 1 Production, but using 9.0 parts of dibehenyl sebacate as an ester wax in place of the Fischer-Tropsch wax.

The acid value of the binder resin in toner particle 5 was 0 mg KOH/g, and its weight-average molecular weight (Mw) was 21,000.

<Toner Particle 6 Production>

A (pretreatment) toner particle 6 was produced by entirely the same method as in Toner Particle 1 Production, but changing the amount of addition of the Fischer-Tropsch wax to 1.5 parts.

The acid value of the binder resin in toner particle 6 was 0 mg KOH/g, and its weight-average molecular weight (Mw) was 20,000.

<Toner Particle 7 Production>

A (pretreatment) toner particle 7 was produced by entirely the same method as in Toner Particle 1 Production, but changing the amount of addition of the Fischer-Tropsch wax to 15.0 parts.

The acid value of the binder resin in toner particle 7 was 0 mg KOH/g, and its weight-average molecular weight (Mw) was 22,000.

<Toner Particle 8 Production>

A (pretreatment) toner particle 8 was produced by entirely the same method as in Toner Particle 1 Production, but changing the amount of addition of the Fischer-Tropsch wax to 0.8 parts.

The acid value of the binder resin in toner particle 8 was 0 mg KOH/g, and its weight-average molecular weight (Mw) was 21,000.

<Toner Particle 9 Production>

A (pretreatment) toner particle 9 was produced by entirely the same method as in Toner Particle 1 Production, but changing the amount of addition of the Fischer-Tropsch wax to 22.0 parts.

The acid value of the binder resin in toner particle 9 was 0 mg KOH/g, and its weight-average molecular weight (Mw) was 20,000.

<Toner Particle 10 Production>

A (pretreatment) toner particle 10 was produced by entirely the same method as in Toner Particle 1 Production, but changing the amount of addition of the Fischer-Tropsch wax to 3.0 parts.

The acid value of the binder resin in toner particle 10 was 0 mg KOH/g, and its weight-average molecular weight (Mw) was 21,000.

<Toner Particle 11 Production>

A (pretreatment) toner particle 11 was produced by entirely the same method as in Toner Particle 1 Production, but changing the amount of addition of the Fischer-Tropsch wax to 25.0 parts.

The acid value of the binder resin in toner particle 11 was 0 mg KOH/g, and its weight-average molecular weight (Mw) was 21,000.

<Toner Particle 12 Production>

A (pretreatment) toner particle 12 was produced by entirely the same method as in Toner Particle 1 Production, but changing the amount of addition of the Fischer-Tropsch wax to 5.5 parts, the amount of addition of the sodium phosphate to 6.9 parts, and the amount of addition of the calcium chloride to 3.9 parts.

The acid value of the binder resin in toner particle 12 was 0 mg KOH/g, and its weight-average molecular weight (Mw) was 22,000.

<Toner Particle 13 Production>

A (pretreatment) toner particle 13 was produced by entirely the same method as in Toner Particle 1 Production, but changing the amount of addition of the Fischer-Tropsch wax to 15.0 parts, the amount of addition of the sodium phosphate to 5.7 parts, and the amount of addition of the calcium chloride to 3.3 parts.

The acid value of the binder resin in toner particle 13 was 0 mg KOH/g, and its weight-average molecular weight (Mw) was 20,000.

<Toner Particle 14 Production>

A (pretreatment) toner particle 14 was produced by entirely the same method as in Toner Particle 1 Production, but changing the amount of addition of the Fischer-Tropsch wax to 3.5 parts, the amount of addition of the sodium phosphate to 7.2 parts, and the amount of addition of the calcium chloride to 4.1 parts.

The acid value of the binder resin in toner particle 14 was 0 mg KOH/g, and its weight-average molecular weight (Mw) was 21,000.

<Toner Particle 15 Production>

A (pretreatment) toner particle 15 was produced by entirely the same method as in Toner Particle 1 Production, but changing the amount of addition of the Fischer-Tropsch wax to 15.0 parts, the amount of addition of the sodium phosphate to 5.4 parts, and the amount of addition of the calcium chloride to 3.1 parts.

The acid value of the binder resin in toner particle 15 was 0 mg KOH/g, and its weight-average molecular weight (Mw) was 22,000.

<Toner Particle 16 Production>

A (pretreatment) toner particle 16 was produced by entirely the same method as in Toner Particle 1 Production, but changing the amount of addition of the Fischer-Tropsch wax to 3.0 parts.

The acid value of the binder resin in toner particle 16 was 0 mg KOH/g, and its weight-average molecular weight (Mw) was 22,000.

<Toner Particle 17 Production>

A (pretreatment) toner particle 17 was produced by entirely the same method as in Toner Particle 1 Production, but changing the amount of addition of the Fischer-Tropsch wax to 3.5 parts.

The acid value of the binder resin in toner particle 17 was 0 mg KOH/g, and its weight-average molecular weight (Mw) was 21,000.

<Toner Particle 18 Production>

(Preparation of Binder Resin Dispersion)

| | |
|---|---|
| styrene | 78.0 parts |
| n-butyl acrylate | 22.0 parts |

The preceding were mixed and dissolved and then dispersed and emulsified in a solution of 1.5 parts of a nonionic surfactant (from Sanyo Chemical industries, Ltd.: Nonipol 400) and 2.2 parts of an anionic surfactant (from DKS Co., Ltd.: Neogen SC) in 120.0 parts of deionized water. Into this was introduced 1.5 parts of ammonium persulfate as polymerization initiator dissolved in 10.0 parts of deionized water. After substitution with nitrogen, heating was carried out while stirring until the temperature reached 70° C. and emulsion polymerization was continued in this state for 4 hours. After this, the amount of deionized water was adjusted to bring the solids fraction concentration to 20.0 mass % to prepare a binder resin dispersion in which a binder resin was dispersed.

(Preparation of Colorant Dispersion)

| | |
|---|---|
| copper phthalocyanine pigment (C.I. Pigment Blue 15:3) | 20.0 parts |
| anionic surfactant (from DKS Co., Ltd.: Neogen SC) | 3.0 parts |
| deionized water | 78.0 parts |

The preceding were mixed and were dispersed using a sand grinder mill. After this, a colorant dispersion was prepared by adjusting the amount of deionized water to bring the solids fraction concentration to 20.0 mass %.

(Preparation of Wax Dispersion)

| | |
|---|---|
| Fischer-Tropsch wax (HNP-51: from Nippon Seiro Co., Ltd., melting point = 77° C.) | 50.0 parts |
| anionic surfactant (from DKS Co., Ltd.: Neogen SC) | 7.0 parts |
| deionized water | 200.0 parts |

The preceding were heated to a temperature of 95° C. and were dispersed using a homogenizer (Ultra-Turrax T50: from IKA Japan K.K.), followed by a dispersion treatment with a pressure-ejection homogenizer. A wax particle dispersion in which wax was dispersed was then prepared by adjusting the amount of deionized water to bring the solids fraction concentration to 20.0 mass %.

(Preparation of Charge Control Particle Dispersion)

| | |
|---|---|
| aluminum salicylate compound (Bontron E-88: from Orient Chemical Industries Co., Ltd.) | 5.0 parts |
| anionic surfactant (from DKS Co., Ltd.: Neogen SC) | 3.0 parts |
| deionized water | 78.0 parts |

The preceding were mixed and were dispersed using a sand grinder mill. After this, a charge control particle dispersion was prepared by adjusting the amount of deionized water to bring the solids fraction concentration to 5.0 mass %.

(Mixture Preparation)

| | |
|---|---|
| binder resin dispersion | 100.0 parts |
| colorant dispersion | 6.0 parts |
| wax dispersion | 15.0 parts |

The preceding were introduced into a 1-L separable flask fitted with a stirring apparatus, a condenser, and a thermometer and were stirred. This mixture was adjusted to pH=5.2 using 1 mol/L potassium hydroxide.

120.0 parts of an 8.0 mass % aqueous sodium chloride solution was added dropwise as an aggregating agent to the mixture and heating was carried out to a temperature of 55° C. while stirring. 2.0 parts of the charge control particle dispersion was added and holding at a temperature of 55° C. was carried out for 2 hours. After the supplemental addition of 3.0 parts of anionic surfactant (from DKS Co., Ltd.: Neogen SC), heating was carried out to a temperature of 95° C. while continuing to stir and holding was carried out for 4.5 hours to obtain a toner particle dispersion 18. After the toner particle dispersion 18 had been cooled, a (pretreatment) toner particle 18 was obtained by filtration, washing, and drying.

The acid value of the binder resin in toner particle 18 was 0 mg KOH/g, and its weight-average molecular weight (Mw) was 24,000.

<Toner Particle 19 Production>

A (pretreatment) toner particle 19 was produced by entirely the same method as in Toner Particle 18 Production, but changing the amount of addition of the wax dispersion to 6.0 parts.

The acid value of the binder resin in toner particle 19 was 0 mg KOH/g, and its weight-average molecular weight (Mw) was 23,000.

<Toner Particle 20 Production>

A (pretreatment) toner particle 20 was produced by entirely the same method as in Toner Particle 2 Production, but changing the amount of addition of the Fischer-Tropsch wax to 3.2 parts.

The acid value of the binder resin in toner particle 20 was 0 mg KOH/g, and its weight-average molecular weight (Mw) was 22,000.

<Toner Particle 21 Production>

A (pretreatment) toner particle 21 was produced by entirely the same method as in Toner Particle 18 Production, but changing the amount of addition of the wax dispersion to 12.5 parts.

The acid value of the binder resin in toner particle 21 was 0 mg KOH/g, and its weight-average molecular weight (Mw) was 24,000.

Examples 1 to 19 and Comparative Examples 1 to 4

A wax distribution control step (carbon dioxide exposure treatment) was carried out on pretreatment toner particle 1 as follows.

Toner particle 1 was subjected to the following treatment. 20 g of the pretreatment toner particle was introduced into the tank Ta of the apparatus shown in FIG. 1. The internal temperature was adjusted to 25° C. and, while stirring at 150 rpm, the valve V1 was opened and carbon dioxide (purity=99.99%) was introduced into the tank Ta from the cylinder B using the pump P. The valve V1 and the valve V2 were adjusted to raise the pressure within the tank Ta to 2.5 MPa. After this, the pump P was stopped and the valve V1 was closed; the valve V2 was adjusted so as to bring the interior of the tank into a sealed state; and holding under pressure was carried out for 60 minutes. After this, the valve V2 was adjusted and the carbon dioxide was discharged to the outside of the tank Ta and the pressure of the tank Ta was dropped to atmospheric pressure. The stirrer was subsequently stopped and the tank Ta was then opened to obtain the post-treatment toner particle 1.

This same treatment was also carried out on the pretreatment toner particles 2 to 21 under the conditions given in Table 1.

For each of the obtained post-treatment toner particles, 1.0 part of silica fine particles having a number-average primary particle diameter of 40 nm was added to 100.0 parts of the toner particle followed by mixing using an FM mixer (from Nippon Coke & Engineering Co., Ltd.) to obtain toners 1 to 19 (toners of Examples 1 to 19) and toners 25 to 28 (toners of Comparative Examples 1 to 4). The properties of the obtained toners are given in Table 1.

Examples 20 to 24

A wax distribution control step (carbon dioxide exposure treatment) was carried out under the conditions given in Table 1 on the toner particle obtained in Toner Particle 1 Production. For each toner particle, 1.0 part of silica fine particles having a number-average primary particle diameter of 40 nm was added to 100.0 parts of the toner particle followed by mixing using an FM mixer to obtain toners 20 to 24 (toners of Examples 20 to 24). The properties of the obtained toners are given in Table 1.

Comparative Examples 5 to 8

A wax distribution control step (carbon dioxide exposure treatment) was carried out under the conditions given in Table 1 on the toner particle obtained in Toner Particle 1 Production. For each toner particle, 1.0 part of silica fine particles having a number-average primary particle diameter of 40 nm was added to 100.0 parts of the toner particle followed by mixing using an FM mixer to obtain toners 29 to 32 (toners of Comparative Examples 5 to 8). The properties of the obtained toners are given in Table 1. In the case of Comparative Example 6 and Comparative Example 8, the toner particle underwent aggregation and melt adhesion in the wax distribution control step and a toner could not be obtained.

TABLE 1

| | toner | carbon dioxide treatment step | | | weight-average particle diameter | wax content | | | | presence/absence of plural |
|---|---|---|---|---|---|---|---|---|---|---|
| Example No. | particle No. | temperature (° C.) | pressure (MPa) | time (hr) | (D4) (μm) | (mass parts) | \|SP1-SP2\| | As (%) | Ac/As | number of domains |
| 1 | 1 | 25 | 2.5 | 1 | 6.5 | 9.0 | 1.50 | 4.7 | 5.1 | present |
| 2 | 2 | 25 | 2.5 | 1 | 6.4 | 9.1 | 1.50 | 6.8 | 3.5 | present |
| 3 | 3 | 25 | 2.5 | 1 | 6.8 | 9.0 | 1.50 | 5.5 | 3.7 | absent |
| 4 | 4 | 25 | 2.5 | 1 | 6.3 | 9.0 | 1.21 | 3.9 | 6.9 | present |

TABLE 1-continued

| Example No. | toner particle No. | carbon dioxide treatment step temperature (° C.) | pressure (MPa) | time (hr) | weight-average particle diameter (D4) (μm) | wax content (mass parts) | \|SP1-SP2\| | As (%) | Ac/As | presence/absence of plural number of domains |
|---|---|---|---|---|---|---|---|---|---|---|
| 5 | 5 | 25 | 2.5 | 1 | 6.2 | 9.0 | 1.03 | 4.1 | 6.8 | present |
| 6 | 6 | 25 | 2.5 | 1 | 6.3 | 1.5 | 1.50 | 3.0 | 2.3 | present |
| 7 | 7 | 25 | 2.5 | 1 | 6.7 | 15.0 | 1.50 | 7.7 | 3.9 | present |
| 8 | 8 | 25 | 2.5 | 1 | 6.1 | 0.8 | 1.50 | 2.2 | 2.2 | present |
| 9 | 9 | 25 | 2.5 | 1 | 7.0 | 22.0 | 1.50 | 8.5 | 4.1 | present |
| 10 | 10 | 25 | 2.5 | 0.5 | 6.2 | 3.0 | 1.50 | 1.8 | 7.5 | present |
| 11 | 11 | 25 | 2.5 | 1 | 7.0 | 25.0 | 1.50 | 9.3 | 4.1 | present |
| 12 | 12 | 25 | 2.5 | 1 | 4.4 | 5.5 | 1.50 | 6.6 | 9.0 | present |
| 13 | 13 | 25 | 2.5 | 1 | 9.5 | 15.0 | 1.50 | 4.2 | 2.9 | present |
| 14 | 14 | 25 | 2.5 | 1 | 3.9 | 3.5 | 1.50 | 6.9 | 9.9 | present |
| 15 | 15 | 25 | 2.5 | 1 | 10.6 | 15.0 | 1.50 | 3.9 | 2.4 | present |
| 16 | 16 | 25 | 2.5 | 1 | 6.5 | 3.0 | 1.50 | 4.5 | 2.3 | present |
| 17 | 1 | 25 | 2.5 | 0.5 | 6.5 | 9.0 | 1.50 | 2.7 | 9.2 | present |
| 18 | 17 | 25 | 2.5 | 0.5 | 6.4 | 3.5 | 1.50 | 1.5 | 9.2 | absent |
| 19 | 18 | 25 | 2.5 | 1 | 6.1 | 15.0 | 1.50 | 16.5 | 2.0 | present |
| 20 | 1 | 25 | 2.5 | 3.5 | 6.5 | 9.0 | 1.50 | 10.2 | 2.0 | present |
| 21 | 1 | 25 | 1.0 | 1 | 6.5 | 9.0 | 1.50 | 2.6 | 9.6 | present |
| 22 | 1 | 25 | 3.5 | 1 | 6.5 | 9.0 | 1.50 | 7.1 | 3.2 | present |
| 23 | 1 | 10 | 2.5 | 1 | 6.5 | 9.0 | 1.50 | 2.5 | 10.0 | present |
| 24 | 1 | 60 | 2.5 | 1 | 6.5 | 9.0 | 1.50 | 7.8 | 2.8 | present |
| Comparative 1 | 19 | 25 | 2.5 | 1 | 6.3 | 6.0 | 1.50 | 8.7 | 1.9 | present |
| Comparative 2 | 2 | 25 | 2.5 | 0.3 | 6.4 | 9.1 | 1.50 | 2.4 | 10.4 | present |
| Comparative 3 | 20 | 25 | 2.5 | 0.5 | 6.6 | 4.1 | 1.50 | 1.4 | 9.9 | present |
| Comparative 4 | 21 | 25 | 2.5 | 1 | 6.6 | 12.5 | 1.50 | 18.3 | 1.0 | present |
| Comparative 5 | 1 | 25 | 0.5 | 1 | 6.5 | 9.0 | 1.50 | 1.2 | 21.1 | present |
| Comparative 6 | 1 | 25 | 4.5 | 1 | 6.5 | 9.0 | 1.50 | could not be measured | | |
| Comparative 7 | 1 | 0 | 2.5 | 1 | 6.5 | 9.0 | 1.50 | 1.3 | 19.5 | present |
| Comparative 8 | 1 | 70 | 2.5 | 1 | 6.5 | 9.0 | 1.50 | could not be measured | | |

In the table, the wax content refers to the amount per 100 parts of the binder resin.

In the table, the "presence/absence of plural number of domains" refers to the presence/absence of a plural number of domains in the surface layer region to a distance of 1.0 μm in the radial direction inward from the toner surface.

Performance evaluations were performed on each of the obtained toners using the following methods.

[Low-Temperature Fixability]

A color laser printer (HP Color LaserJet 3525dn, from HP Inc.) from which the fixing unit was removed was prepared; the toner was removed from the cyan cartridge; and the toner to be evaluated was filled as a replacement. Then, using the filled toner, a 2.0 cm long by 15.0 cm wide unfixed toner image (toner laid-on level=0.9 mg/cm$^2$) was formed on the image-receiving paper (HP Laser Jet90, from HP Inc., 90 g/m$^2$) at a position 1.0 cm from the top edge considered in the paper transit direction. The removed fixing unit was modified so the fixation temperature and process speed could be adjusted and was used to conduct a fixing test on the unfixed image.

First, operating in a normal-temperature, normal-humidity environment (23° C., 60% RH) with the process speed set to 250 mm/s and the initial temperature set to 110° C., the unfixed image was fixed at each temperature while raising the set temperature sequentially in 5° C. increments.

The evaluation criteria for the low-temperature fixability are given below. The low-temperature-side fixing starting point is the lower temperature limit at which a cold offset phenomenon (phenomenon in which a portion of the toner adheres to the fixing unit) is not observed.

A: the low-temperature-side fixing starting point is not more than 130° C. (the low-temperature fixability is particularly excellent)

B: the low-temperature-side fixing starting point is at least 135° C. and not more than 145° C. (excellent low-temperature fixability)

C: the low-temperature-side fixing starting point is at least 150° C. and not more than 160° C. (good low-temperature fixability)

D: the low-temperature-side fixing starting point is at least 165° C. and not more than 175° C. (somewhat poor low-temperature fixability)

E: the low-temperature-side fixing starting point is at least 180° C. (poor low-temperature fixability)

[Fixed Image Bending Strength]

A fixed image, fixed at a temperature of 20° C.+the low-temperature-side fixing starting point in the above-described low-temperature fixability test, was rubbed 3 times in the same direction with lens-cleaning paper (from Ozu Corporation: DUSPER K-3) under a load of 4.9 kPa (50 g/cm$^2$). The percentage decline in the density pre-versus-post-rubbing was taken to be the bending strength of the fixed image. The evaluation criteria for the bending strength of the fixed image are as follows.

A: the density decline percentage is less than 5% (the bending strength is particularly excellent)

B: the density decline percentage is at least and less than 10% (excellent bending strength)

C: the density decline percentage is at least 10% and less than 15% (good bending strength)

D: the density decline percentage is at least 15% and less than 20% (somewhat poor bending strength)

E: the density decline percentage is at least 20% (poor bending strength)

[High-Temperature Fixability]

A color laser printer (HP Color LaserJet 3525dn, from HP Inc.) from which the fixing unit was removed was prepared;

the toner was removed from the cyan cartridge; and the toner to be evaluated was filled as a replacement. Then, using the filled toner, a 2.0 cm long by 15.0 cm wide unfixed toner image (toner laid-on level=0.9 mg/cm$^2$) was formed on the image-receiving paper (HP Laser Jet90, from HP Inc., 90 g/m$^2$) at a position 1.0 cm from the top edge considered in the paper transit direction. The removed fixing unit was modified so the fixation temperature and process speed could be adjusted and was used to conduct a fixing test on the unfixed image.

First, operating in a normal-temperature, normal-humidity environment (23° C., 60% RH) with the process speed set to 250 mm/s and the initial temperature set to 170° C., the unfixed image was fixed at each temperature while raising the set temperature sequentially in 5° C. increments.

The high-temperature fixability was evaluated as follows based on the temperature range in which a hot offset phenomenon (phenomenon in which a portion of the toner adheres to the fixing unit) was observed.

A: offset is produced at at least 215° C. (the high-temperature fixability is particularly excellent)

B: offset is produced at at least 205° C. and not more than 210° C. (excellent high-temperature fixability)

C: offset is produced at at least 195° C. and not more than 200° C. (good high-temperature fixability)

D: offset is produced at not more than 190° C. (somewhat poor high-temperature fixability)

[Gloss]

A color laser printer (HP Color LaserJet 3525dn, from HP Inc.) from which the fixing unit was removed was prepared; the toner was removed from the cyan cartridge; and the toner to be evaluated was filled as a replacement. Then, using the filled toner, an unfixed solid image (toner laid-on level=0.6 mg/cm$^2$) was formed on the image-receiving paper (XEROX 4200, from Xerox Corporation, 75 g/m$^2$). The removed fixing unit was modified so the fixation temperature and process speed could be adjusted, and the unfixed image was fixed at 170° C. and a process speed of 250 mm/s in a normal-temperature, normal-humidity environment (23° C., 60% RH). The gloss value was measured using a PG-3D (from Nippon Denshoku Industries Co., Ltd.). The evaluation criteria are as follows.

A: the gloss value is at least 30

B: the gloss value is at least 25 and less than 30

C: the gloss value is at least 20 and less than 25

D: the gloss value is at least 15 and less than 20

E: the gloss value is less than 15

The results of the performance evaluation of the toners are given in Table 2.

TABLE 2

| Example No. | toner No. | low-temperature fixability | high-temperature fixability | gloss | bending strength |
|---|---|---|---|---|---|
| 1 | 1 | A | A | A | A |
| 2 | 2 | B | A | A | A |
| 3 | 3 | B | A | A | A |
| 4 | 4 | B | B | A | A |
| 5 | 5 | C | C | A | A |
| 6 | 6 | B | B | B | A |
| 7 | 7 | A | A | B | B |
| 8 | 8 | C | B | B | A |
| 9 | 9 | A | A | B | B |
| 10 | 10 | C | B | A | A |
| 11 | 11 | A | A | A | C |
| 12 | 12 | A | B | A | A |
| 13 | 13 | B | A | A | A |

TABLE 2-continued

| Example No. | toner No. | low-temperature fixability | high-temperature fixability | gloss | bending strength |
|---|---|---|---|---|---|
| 14 | 14 | A | C | B | A |
| 15 | 15 | C | A | A | A |
| 16 | 16 | A | A | B | A |
| 17 | 17 | B | A | A | A |
| 18 | 18 | C | B | A | A |
| 19 | 19 | A | A | C | B |
| 20 | 20 | A | A | B | C |
| 21 | 21 | C | B | A | A |
| 22 | 22 | A | A | B | B |
| 23 | 23 | B | A | A | A |
| 24 | 24 | A | A | B | B |
| Comparative 1 | 25 | A | A | D | D |
| Comparative 2 | 26 | D | B | A | C |
| Comparative 3 | 27 | D | C | B | A |
| Comparative 4 | 28 | A | A | B | D |
| Comparative 5 | 29 | D | A | A | D |
| Comparative 6 | 30 | could not be evaluated | | | |
| Comparative 7 | 31 | D | A | A | D |
| Comparative 8 | 32 | could not be evaluated | | | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-237729, filed Dec. 4, 2015, which is hereby incorporated by reference herein in its entirety.

What is claimed is:

1. A toner comprising a toner particle containing a binder resin and a wax, wherein the toner has a weight-average particle diameter of 5 to 8 μm, in a cross sectional image of the toner observed with a transmission electron microscope, the toner satisfies formulae (1) and (2)

$$18.0\% \geq As \geq 1.5\% \quad (1)$$

where As represents a proportion for an area taken up by the wax present in a surface layer region relative to the area of the surface layer region, the surface layer region having distance 1.0 μm in a radial direction inward from a surface of the toner, $$10.0 \geq Ac/As \geq 2.0 \quad (2)$$

where Ac represents a proportion for an area taken up by the wax present in an inner region relative to the area of the inner region, the inner region positioned further inside than the surface layer region.

2. The toner according to claim 1, wherein As is 2.0 to 15.0%.

3. The toner according to claim 1, wherein a content of the wax is 1.0 to 20.0 mass parts per 100 mass parts of the binder resin.

4. The toner according to claim 1, wherein the solubility parameter SP1 of the binder resin and the solubility parameter SP2 of the wax satisfy $|SP1-SP2| \geq 1.10$.

5. The toner according to claim 1, wherein the wax comprises a hydrocarbon wax.

6. The toner according to claim 1, wherein the wax present in the surface layer region is present as a plurality of domains.

7. The toner according to claim 4, wherein the solubility parameter SP1 and the solubility parameter SP2 satisfy $1.10 \leq |SP1-SP2| \leq 1.80$.

8. The toner according to claim 1, wherein at least 5 domains of wax having a long axis of 0.05 to 1.00 μm are observed in the surface layer region.

9. A method of producing a toner comprising a toner particle containing a binder resin and a wax, the toner having a weight-average particle diameter of 5 to 8 μm and in a cross sectional image of the toner observed with a transmission electron microscope, the toner satisfies formulae (1) and (2)

$$18.0\% \geq As \geq 1.5\% \quad (1)$$

where As represents a proportion for an area taken up by the wax present in a surface layer region relative to the area of the surface layer region, the surface layer region having distance 1.0 um in a radial direction inward from a surface of the toner, $$10.0 \geq Ac/As > 2.0 \quad (2)$$

where Ac represents a proportion for an area taken up by the wax present in an inner region relative to the area of the inner region, the inner region positioned further inside than the surface layer region, the method comprising exposure treatment step (A) or (B):

(A) a step of obtaining a toner particle by exposing a pretreatment toner particle containing the binder resin and the wax to carbon dioxide, or (B) a step of obtaining a toner by exposing a pretreatment toner containing an external additive and a toner particle containing the binder resin and the wax to carbon dioxide, wherein a temperature of the carbon dioxide in the exposure treatment step is from 10 to 60° C. and a pressure thereof is from 1.0 to 3.5 MPa.

10. The method of producing the toner according to claim 9, wherein an acid value of the binder resin is not more than 15.0 mg KOH/g.

11. The method of producing the toner according to claim 9, wherein a weight-average molecular weight (Mw) of the binder resin is from 10,000 to 50,000.

12. The method of producing the toner according to claim 9, wherein the binder resin comprises a styrene-acrylic resin.

13. The method of producing the toner according to claim 9, wherein a content of the wax is from 1.0 to 20.0 mass parts per 100 mass parts of the binder resin.

14. The method of producing the toner according to claim 9, wherein the solubility parameter SP1 of the binder resin and the solubility parameter SP2 of the wax satisfy $|SP1-SP2| \geq 1.10$.

15. The method of producing the toner according to claim 9, wherein the wax comprises a hydrocarbon wax.

16. The method of producing the toner according to claim 9, wherein a time in the exposure treatment step is from 5 to 180 minutes.

17. The method of producing the toner according to claim 9, further comprising:

a step of obtaining a toner particle containing the binder resin and the wax through a granulation step of forming droplets in an aqueous medium.

18. The method of producing the toner according to claim 9, further comprising a step of obtaining the toner particle that contains the binder resin and the wax, the step comprising:

preparing a polymerizable monomer composition that contains the wax and a polymerizable monomer that constitute the binder resin;

dispersing the polymerizable monomer composition in an aqueous medium to form droplets of the polymerizable polymer composition; and polymerizing the polymerizable monomer in the droplets.

* * * * *